US005105779A

United States Patent [19]

Thompson

[11] Patent Number: 5,105,779

[45] Date of Patent: Apr. 21, 1992

[54] CYLINDER BLANKING SYSTEM FOR INTERNAL COMBUSTION ENGINE

[75] Inventor: Larry L. Thompson, Phoenix, Ariz.

[73] Assignee: Kinetic Technology, Inc., Phoenix, Ariz.

[21] Appl. No.: 588,338

[22] Filed: Sep. 26, 1990

[51] Int. Cl.[5] ..... F02B 77/00; F02D 17/00

[52] U.S. Cl. ..... 123/198 F; 123/481

[58] Field of Search ..... 123/198 DB, 198 F, 481, 123/198 D

[56] References Cited

U.S. PATENT DOCUMENTS 3,763,397 10/1973 Yockers ..... 123/198 D
4,204,512 5/1980 Brock, Jr. ..... 123/198 F
4,224,920 9/1980 Sugasawa et al. ..... 123/198 F
4,608,952 9/1986 Morita et al. ..... 123/198 F

FOREIGN PATENT DOCUMENTS 52-56229 5/1977 Japan ..... 123/198 F

*Primary Examiner*—Noah P. Kamen
*Attorney, Agent, or Firm*—Gregory J. Nelson

[57] ABSTRACT

A combustion engine is provided having a cylinder blanking system. The cylinders are deactived according to turbo-pressure and engine RPM. Specifically, when low load conditions exist for a predetermined period of time, fuel is cut off from some of the cylinders. The system may be manually overriden.

12 Claims, 3 Drawing Sheets

FUEL
52
46
30
152
50
142
138
140
34
44
20
66
34
62
60
58
54
68
42
56
114
22
24
116

36
5
3
20
68
5
54
58
46
38
32
AIR
34
40
152
3

50
142
154
158
156
160
AIR SUPPLY
164
F
TO PISTON CHAMBER
162
166
150

TO TURBO PRESSURE
170
175
174
180
172
182
176
TIMER
PRESSURE SWITCH
186

142
156A
AIR SUPPLY
F
TO PISTON CHAMBER
166A
192

TO TURBO PRESSURE
TO TACHOMETER (RPM PICKUP)
170A
175A
174A
172A
190
TIMER
SPEED SENSOR
PRESSURE SWITCH
186A
178A

CYLINDER BLANKING SYSTEM FOR INTERNAL COMBUSTION ENGINE

BACKGROUND OF THE INVENTION

1. Field of the Invention

The present invention relates to a fuel saving device and more particularly relates to a system for intermittently interrupting fuel flow to selected cylinders in internal combustion engines having particular applicability to combustion ignition engines.

Various systems can be found in the prior art for blanking or de-activating predetermined cylinders of a combustion engine in order to reduce fuel comsumption. The underlying theory of operation of such systems is simple: reduce or shut-off fuel to selected cylinders under low load conditions to achieve better fuel economy. Various patents can be found showing systems which operate on this principle.

2. Description of Related Art

U.S. Pat. No. 4,080,947 discloses a system of controlling ignition in multi-cylinder engines in which the air-fuel mixture in one or more of the cylinders is cut-off depending upon load conditions. The system uses signals detected by the vehicle speed sensor, engine RPM sensor, and intake pressure senser.

U.S. Pat. No. 4,434,767 discloses a control system which controls the number of working cylinders so that actual torque requirements are maintained. Engine speed is detected and the system operates to maintain constant intake pressure.

U.S. Pat. No. 4,509,488 shows an apparatus in which working strokes of a multi-cylinder engine are skipped in approximate uniform distribution dependent on the load.

U.S. Pat. No. 4,541,387 shows a system for controlling fuel injection having fuel injection control circuit responsive to the load on the engine to selectively cut-off fuel to a corresponding cylinder.

U.S. Pat. No. 4,552,114 shows an apparatus for controlling the number of operative cylinders in a diesel engine having a fuel injector pump which is controlled by an electromagnetic valve. A control circuit detects the operating condition of the engine to determine the number of cylinders to be operated. The system includes a register for storing the cylinder control data from the control circuit, a pulse generating circuit responsive to the cylinder pulse and synchronized with shaft rotation and the stored value of the register to control the application of the valve opening pulses to the electromagnetic valve.

U.S. Pat. No. 4,640,241 shows a skip-cylinder system having a decision circuit which selects the cylinder or cylinders which are to be operative.

U.S. Pat. No. 4,909,223 discloses an air-fuel ratio control apparatus which senses the number of parameters including the air-fuel ratio, crank angle for detecting engine speed and the position of the piston in each cylinder as well as intake air flow.

U.S. Pat. No. 4,204,512 discloses a cylinder deactivator system for an internal combustion engine. Each valve train has a rocker lever assembly and a rocker lever shaft The rocker lever assembly has a first member and a second member that are joined at the mid-section of the rocker lever assembly and are commonly mounted on a shaft. A fluid pressure cylinder assembly has a piston rod and a pawl mounted on the end of the piston rod. Two of the opposite surfaces of the pawl mate with shoulder surfaces of the first and second members in the manner of a keystone when the particular cylinder is operational. In the configuration applicable to diesel engines, a fluid pressure assembly also controls the operation of the fuel injector.

In addition to the foregoing, other systems can be found which de-activate or blank-out cylinders of internal combustion engines in order to conserve fuel. However, most of these systems have not achieved any substantial degree of success or acceptance due either to their complexity, their lack of reliability or failure to quickly re-activate blanked cylinders when additional power is needed.

Accordingly, it is an object of the present invention to provide a cylinder blanking system for internal combustion engines.

It is another object of the present invention to provide a cylinder de-activation system that monitors turbo pressure and may also monitor engine RPM and is responsive to these engine operating characteristics.

It is an object of the invention to provide a cylinder blanking system which senses selected engine parameters and initiates blanking only after certain conditions exist for a predetermined period of time.

It is another object of the present invention to provide a cylinder de-activation system for internal combustion engines which may be manually overriden by the operator.

It is another object of the present invention to provide a novel cylinder blanking system which may be retrofit to most conventional combustion ignition engines.

It is a specific object of the present invention to provide a cylinder blanking system which blanks selected cylinders by interrupting fuel flow by holding a fuel system component such as a fuel injector in a non-actuated position during cylinder blanking.

SUMMARY OF THE INVENTION

Briefly, the present invention operates to shutoff fuel to selected engine cylinders under low load conditions and is particularly applicable to fuel injected combustion ignition or diesel engines. Fuel is normally delivered to the injectors under the influence of a fuel pump. A rocker arm or rocker lever selectively actuates the injector plunger to deliver fuel into the cylinders. As the plunger is moved, the plunger allows more or less fuel into the injector depending on demand. Excess fuel is returned through the fuel system. The blanking system of the invention is incorporated in a housing enclosing the rocker arm assemblies which actuate the injectors which deliver fuel to selected cylinders. Typically, in a six-cylinder engine, two adjacent cylinders 180° out of phase would be selected for blanking operation. The housing defines a pair of cylinder bores each of which house a control piston and piston rod. Each cylinder is connected to a source of fluid such as air across a control valve which selectively pressurizes the cylinder to extend the piston and piston rod. In the extended position, the control piston rod will engage the rocker arm to hold the needle valve in position which interrupts fuel flow.

The control valve is operated to actuate the control piston when selected engine operating parameters are within predetermined ranges. In a basic embodiment of the invention, the blanking system monitors engine turbo pressure and when the turbo pressure is below a predetermined set point, the control valve is operated to actuate the piston to blank out selected cylinders. In other embodiments, additional engine parameters such as engine speed may also be monitored and the blanking system operation is initiated only when several parameters are within established limits creating a "window" during which the system operates. The system is also provided with a manual override and incorporates a timer station which requires that the monitored operational parameters be maintained for a predetermined length of time to prevent the system from rapidly fluttering or oscillating between an "on" and "off" condition. As used throughout the specification, reference to an "on" condition refers to the present cylinder blanking system functioning to interrupt fuel flow and "off" to a condition permitting normal engine operation usually during load conditions.

BRIEF DESCRIPTION OF THE DRAWINGS

The above and other objects and advantages of the present invention will become more apparent from the following description, claims and drawings in which:

DESCRIPTION OF THE PREFERRED EMBODIMENTS

Figure 1:
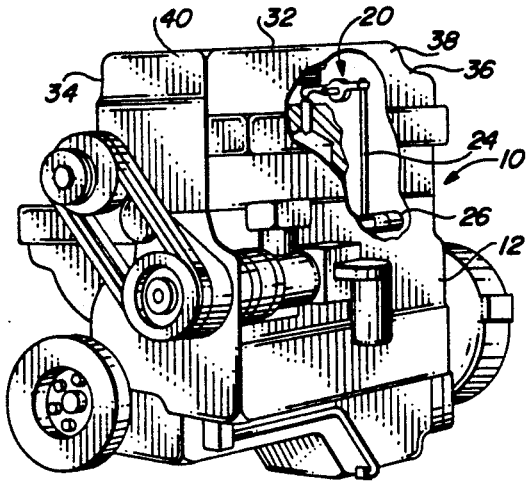
FIG. 1 is a perspective view of a combustion ignition engine showing the blanking system of the present invention installed thereon with portions of the engine broken away to illustrate some of the internal engine components.

Turning now to the drawings FIG. 1 illustrates the present invention applied to a conventional compression ignition (CI) engine 10. Typical of these engines are those manufactured by Cummins Diesel, Caterpillar and Detroit Diesel. For example, a Cummins engine of this type is the C424 engine. These engines typically have a block 12 having a plurality of pistons reciprocal within cylinder bores. The block may be an in-line configuration as shown or in some instances may be in a V-configuration. Pistons 14 are connected to the crank shaft by means of crank arms. The introduction of air and the discharge of exhaust is controlled by appropriate valving, not shown. Similarly, the admission of fuel to the various cylinders to support combustion is controlled by rocker arm assemblies 20 which operatively engage fuel injectors 22 associated with the various cylinders. The rocker arms 20 are positioned responsive to cam shaft 26 and push rods 24. These components are well known and conventional and set forth only to facilitate an understanding of the invention.

As a piston in the combustion ignition engine moves towards top dead center, a decrease in volume occurs within the cylinder chamber and both pressure and temperature are much greater than at the beginning of the compression cycle. Temperature within the chamber may be in the range of 1000° F. This indicates that mechanical energy in the form of force applied to the piston has been transformed into heat energy in the compressed air in the chamber. The temperature of the air has been raised to a point sufficient to cause ignition of fuel when fuel is injected into the cylinder. As indicated above, the fuel is injected at the appropriate point in the cylinder through the injectors 22 in response to the position of the cam shaft.

Ignition generally occurs shortly before top dead center and after ignition a substantial increase in the pressure and temperature occurs. The increased pressure forces the piston downwardly and as the piston moves downwardly, the gases expand or increase in volume and the pressure and temperature decrease rapidly.

In conventional engines, all cylinders are operative and fuel is injected into all cylinders even at modest operating conditions. To this end, the present invention is shown associated with two cylinders for selectively blanking out or de-activating selected cylinders.

The present invention is generally designated by the numeral 30 and is associated with two adjacent cylinders in the in-line six-cylinder CI engine shown. In the six-cylinder engine architecture, the cylinders selected blanking operations should be 180° out of phase and adjacent one another. Generally it is recommended or preferred that blanking be applied to no more than two cylinders in a six-cylinder engine.

As best seen in FIGS. 1 to 4, the blanking system includes a housing 32 which is shown as an integrally formed casting having opposite side walls 34, 36 and end walls 38 and 40 arranged in generally rectilinear fashion. The housing is preferably sized and shaped to adapt to replace the existing conventional rocker lever housing which conventionally encloses the rockers, injectors and related components at the top of the engine block.

Flanges 42 extend from the housing at predetermined locations having bores therein adapted to align with studs or bolt holes in the engine block to facilitate securing the housing to the engine block at these locations. The housing defines a compartment 44 which encloses the upper end of the injector rocker arms 20 and the push rods 24. The rocker arms or levers which operate the intake and exhaust valves are also located within the housing but have been omitted for purposes of clarity since these form no part of the present invention.

A section of the side wall 34 adjacent each rocker arm is enlarged at 46 and defines a downwardly opening cylindrical piston chamber 50 whose axis is generally aligned with the axis of injector 22. A cover 52 is securable over the housing by bolts or other fasteners.

As indicated above, a fuel rocker arm assembly 20 is associated with each cylinder. The rocker arm assemblies are substantially identical, the description of one such assemblies will be sufficient and apply to all. Each of the rocker arm assemblies 20 is mounted on a rocker arm shaft 54 at a bore 56 in the rocker arm assembly. The rocker arm assembly has first generally horizontal arm 58 terminating at a downwardly turned distal end 60 aligned with the upper end of fuel injector 22. The upper side rocker arm 58 defines a bearing surface 62 against which piston 66 acts as will be more fully explained hereafter.

Figure 5:
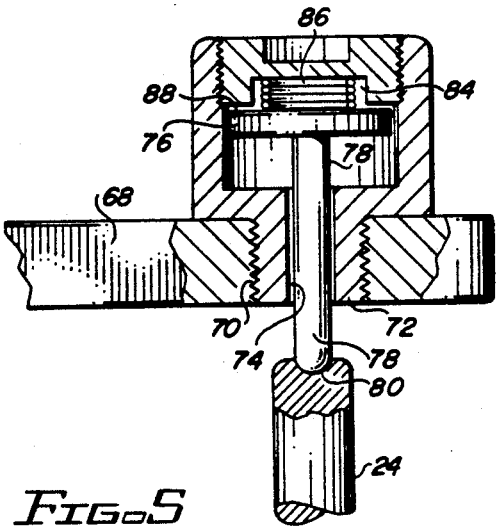
FIG. 5 is a sectional view of the upper end of push rod and rocker arm connection as indicated in FIG. 2.
Figure 3:
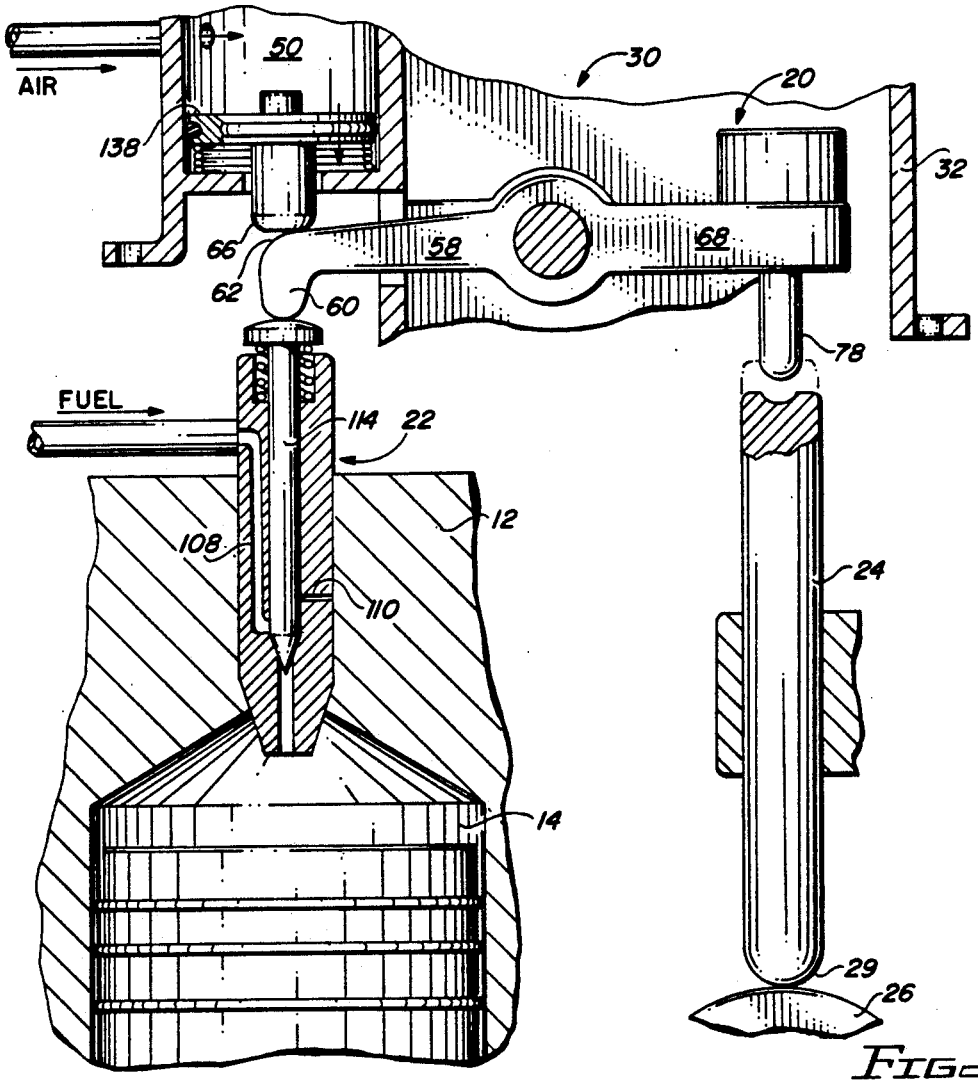
FIG. 3 is a sectional view taken along lines 3—3 of FIG. 2 showing the injector in a closed or "on" blanking position.
Figure 4:
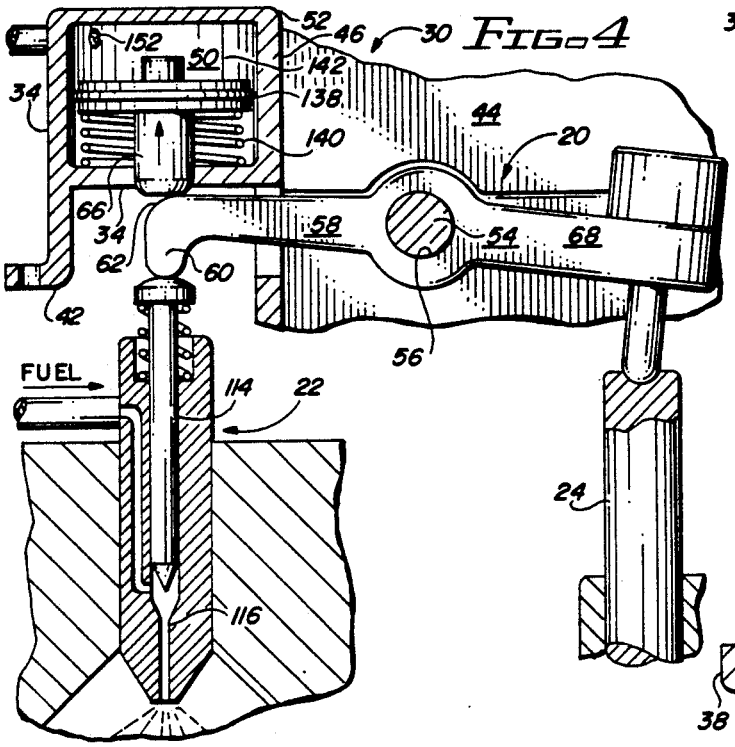
FIG. 4 is a sectional view similar to FIG. 3 showing the injector in a normal operating position with the blanking system "off"
Figure 2:
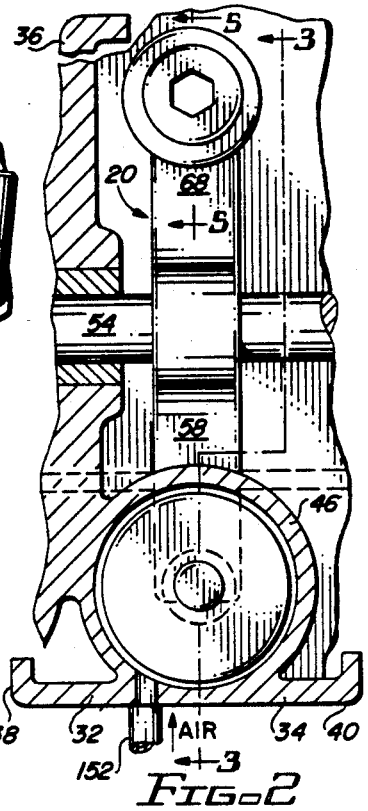
FIG. 2 is a top view of a portion of the engine showing the housing for the blanking system and the enclosed components.

As best seen in FIGS. 3, 4 and 5, rocker assembly 25 has a second arm 68 oppositely extending from arm 58 and integral therewith which arm has a generally vertical threaded bore 70 therein. Bore 70 receives an externally threaded stud 72 having an axial bore 74 therethrough. The upper end of stud 72 carries an enlarged head 76 having an enlarged opening therein. A plunger 78 has a generally elongated body reciprocal within bore 74. Plunger 78 terminates at its lower end at a rounded end 80. The upper end of the plunger is provided with an enlarged head 76 which is received in the upper end of the stud. The upper surface of the head engages shoulder 84 within the head of the stud. A recess in the head of the stud receives a spring 86 which acts against the upper surface of the head of the plunger. A clearance 88 exists between the underside of the head of the plunger and the inside of the chamber in the head of the stud housing. Thus, it will be seen that the plunger and rocker arm operate as a rigid member when the plunger is moved upwardly with motion being transferred through the head of the stud to the rocker arm 58. In the downward plunger direction, some relative movement between the plunger and the threaded stud and rocker assembly is permitted at clearance space 88. In this way, if the rocker arm 68 is held in a fixed position, plunger 78 will move downwardly under the influence of spring 86 following the downward movement of the push rod 24 to maintain continual contact therebetween. Upward movement of the push rod 24 will be transferred via the plunger and cap member to cause the upward movement of rocker arm member 68 and the corresponding downward movement of opposite rocker arm member 58. Push rod 24 is reciprocally operated in a predetermined cycle in known manner from cam 26 and cam follower 90 at the lower end of the push rod.

Figure 6:
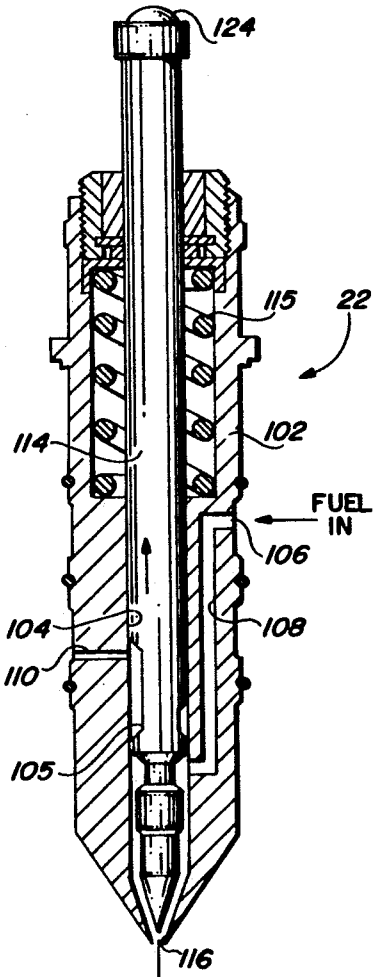
FIG. 6 is a cross-sectional view of a typical fuel injector.

In the normal sequence of operation, the downward movement of the push rod 24 will impart an upward motion to rocker arm member 58 which causes fuel to be injected into the cylinder chamber. Various designs can be found for injectors of this type and the one shown in FIG. 6 is representative. The injector construction shown in FIGS. 3 and 5 has been simplified, the construction of FIG. 6 being typical.

The injector shown in FIG. 6 has a housing 102 defining a longitudinally extending bore 104. The bore communicates with an inlet fuel port 106 via passageway 108. Fuel exits from the injector via port 110 communicating with the injector bore via passageway 112. A valve plunger 114 is reciprocal within the bore 104. A discharge port 116 is provided at the end of the bore. Biasing spring 115 urges the valve plunger to the normally open position as shown in FIG. 6 in which fuel is directed to the discharge 116. When force is applied to the outer end 124 of the valve plunger 114, the plunger is moved downward to block communication between the inlet port 106 and port 116 and fuel flow is terminated. In this condition, the plunger 114 moves down so fuel is shunted through the valve at annular groove 105 and discharged to return to the fuel system at port 110. As indicated, this construction is representative of any number of injector designs. Further details have not been described in the interest of clarity. It is understood that the design of the injector forms no particular part of the invention as the invention is applicable to a wide variety of injector designs. Also, the injector is shown in FIGS. 3 and 4 has been simplified for clarity.

The position of the plunger 114 is normally controlled by the rocker arm 20 which is responsive to the push rod 24 to transmit movement to the rocker arm 20 and to the injector plunger 114. The present invention operates to blank or de-activate selected cylinders by maintaining the injector 22 in an inoperative position regardless of the position of the cam and associated push rod 24. This is accomplished by selectively holding the rocker arm assembly 20 in a position to maintain the injector 22 in a fuel flow terminating condition. This is accomplished by a control cylinder 50 which reciporcally houses control piston 66.

The control piston 66 is aligned with the end of the rocker arm 58 and the injector 22 of the cylinder to be rendered inoperative. As best seen in FIGS. 3 and 5, piston 66 is reciprocal within the piston chamber and extends through end cap 134. Piston 66 is carried on a control cylinder 138 which is generally cylindrical having its edges in sealing contact with the interior walls of the piston chamber 50. The piston is normally biased by spring 140 to a retracted position as shown in FIG. 4. When the piston chamber area 142 defined between the bottom of the bore and the upper face of the piston is pressurized, the piston and piston rod will move downwardly bringing the lower end of the piston 66 into engagement with the rocker arm at bearing surface 62 positioning the injector plunger in a position where fuel flow to the engine cylinder is terminated as seen in FIG. 5. In this condition, rocker arm 68 is in a position corresponding to the high point of cam shaft 26. As the cam continues to rotate from the high point on the cam towards the low point on the cam, the spring-loaded plunger 78 associated with arm 68 will move downwardly with the push rod 24 to maintain continual contact between the push rod and the plunger. Therefore, when the blanking operation is terminated, the rocker assembly 20 will immediately resume its normal operation under the control of the cam 26 and push rod 24.

Figure 7:
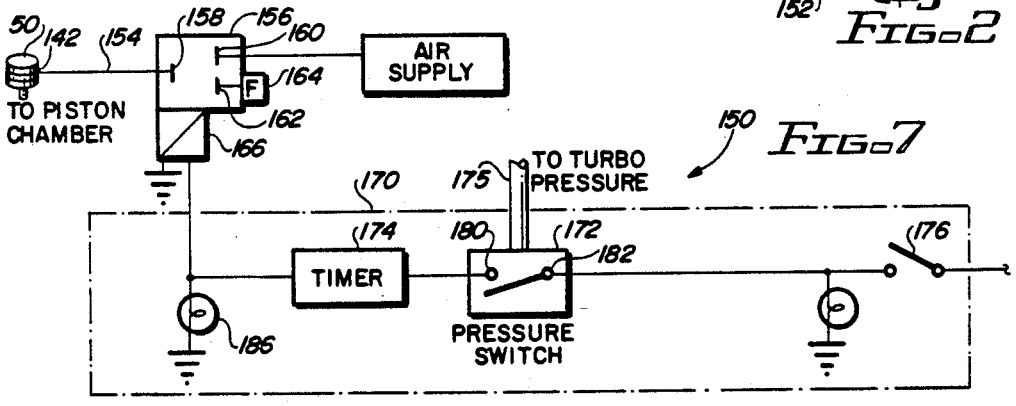
FIG. 7 is a schematic diagram of the control system for the blanking system.

The control piston 66 is operated by the control system 150 shown in FIG. 7. Fluid pressure is directed to chamber 142 via passageway 152. As shown, passageway 152 connects the chambers of the adjacent blanking control piston assemblies. Passageway 152 is connected via line 154 to control valve 156. Control valve 156 is shown as a pneumatic control valve having a port 158 connected to line 54. Port 160 is connected to a source of fluid pressure such as a source of compressed air 165 typically at 100 psi. Port 162 communicates with atmosphere across a filter 164. Control valve 156 has an internal valve spool, not shown, which is positionable by solenoid operator 166 to selectively place outlet port 158 in communication with either port 160 or atmosphere at port 162.

The solenoid operator is selectively energized by an electrical circuit 170 which includes a pressure switch 172 and a timer 174. The electrical circuit is connected to a suitable source of power such as the electrical system of the vehicle. The operation of the entire electrical system may be manually interrupted at on-off switch 176. Indicator light 178, preferably positioned on the instrument panel of the vehicle, indicates that the blanking system is in an operative or controlling condition.

The pressure switch 172 is electrically connected in an electric circuit and is pneumatically connected to the turbo system of the vehicle at line 175 to monitor or sense turbo pressure. The pressure switch is responsive to turbo pressure and at a pre-set turbo pressure will close completing the electrical circuit between contacts 180 and 182. Above a pre-set limiting pressure, switch 172 will open interrupting the electrical connection between contacts 180 and 182. Typically, the pressure switch will be set to open above turbo pressures of 14 or 15 psi. Pressure switches of this type are known in the art and a typical switch is the type manufactured by Stewart Warner.

Contact 182 is electrically connected to solid state timer 174. The output of timer 174 is connected to the solenoid operator 166. Timer 174 may be pre-set for a predetermined operational period. For example, the timer must be energized for 30 seconds before the solenoid operator is energized. The purpose of the timer is to even out or stabilize the system so that small variations or fluctuations in turbo pressure do not cause the solenoid operator and the control valve 156 to continually fluctuate.

An indicator light 186 is electrically connected to the output of the timer preferably located on the instrument panel of the vehicle and indicates that the blanking system is in operation and that selected cylinders of the engine are inoperative.

With the cylinder blanking system installed on an engine 10 as described above, the operation is as follows: The control valve 156 is connected to a suitable source of air and the electrical system 120 controlling the operation of the solenoid operator connected to a source of electrical energy such as the vehicle electrical system. The control valve 156 is connected to the chamber 142 of the control cylinder 50. In the normal operation of the engine, fuel is delivered to the fuel injectors 22 and the associated rocker arms 20 actuate the injector plunger 114 to deliver fuel to the cylinders. Excess fuel is returned to the fuel system at port 110 with some fuel flow through the injector generally being necessary to cool the injector. In the normal engine operation, the position of the injector plunger is controlled by the cam operating through the push rod 24 and rocker arms 20.

If the cylinder blanking system is desired to be used, the on-off switch 176 is placed in an "on" position which activated condition will be indicate by indicator light 178. In this condition, monitored turbo pressure below the set point of switch 172 will actuate timer 174. After a predetermined time, timer 174 will energize solenoid 166 causing control valve 156 to pressurize the control piston and move piston 66 into contact with the rocker arm holding the injector in a fuel-terminating position shown in FIG. 3. This operational condition is indicated by light 186. Increased turbo pressure above the set point of switch 172 will cause the pressure switch 172 to interrupt the electrical circuit. This, in turn, will de-activate the solenoid operator 166 causing the control valve to move to the position venting the control cylinder chamber which, in turn, will cause the piston 66 to retract within its chamber removing the force retaining the rocker arm end 60 in the blanking position. At this point, the normal operation of the rocker arm will resume allowing the normal operation of the fuel injector 22 as shown in FIG. 4.

Figure 8:
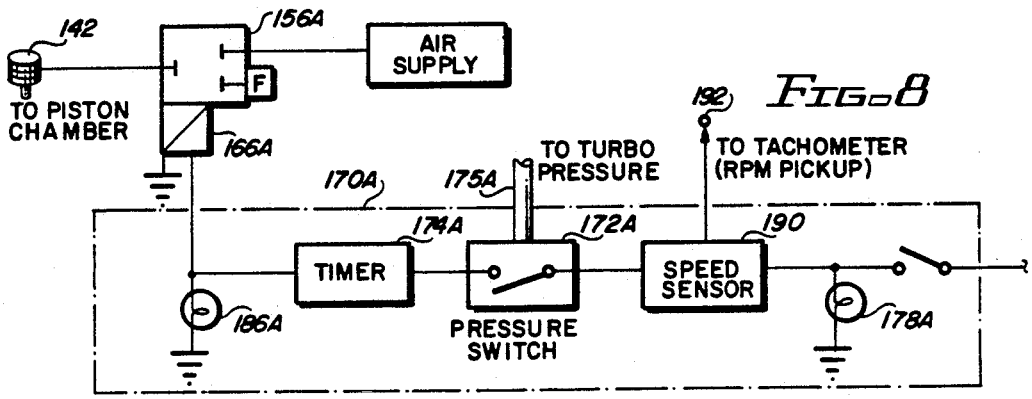
FIG. 8 is schematic diagram of an alternate embodiment of a control system for the blanking system for an internal combustion engine.

FIG. 8 shows an alternate embodiment of the control system in which several operating conditions of the engine are monitored and utilized to control the actuation of the control valve 156A. In FIG. 6 the control valve 156A, solenoid operator 160A, timer 174A, turbo pressure switch 172A are connected as have been described above and have been indicated with the same numerals used above but with an appended "A". In addition, indicator lights 178A and 186A also provide a visual indication to the driver that the system is on and whether or not it is operating to blank cylinders. In the system shown in FIG. 8, an additional parameter or operating condition is monitored and certain conditions with respect to this parameter must be satisfied before the blanking system becomes operational. Accordingly, an additional switch 190 is interposed ahead of the timer 174A which switch is responsive to engine RPM. Engine RPM may be sensed at the electrical pick-up point 192 which is directed to the electrical tachometer on most diesel engines. Alternately, engine speed can be monitored in any number of ways optically or magnetically. One such method involves magnetically sensing the teeth on the flywheel and processing this signal through a counter and comparator and using the output of the comparator to operate switch 190. In order for the blanking system to become operational, engine RPM must be within certain ranges as for example between 0 and 700 RPM or between approximately 1500 and 2200 RPM. With the system of FIG. 8, turbo pressure must also be below a predetermined level and further these conditions must exist for a predetermined time prior, as for example 20 seconds, to initiation of blanking. In other respects the system operates as described above with air being directed to chamber 142 of control cylinder 50 to extend piston 66 to accomplish blanking.

Figure 9:
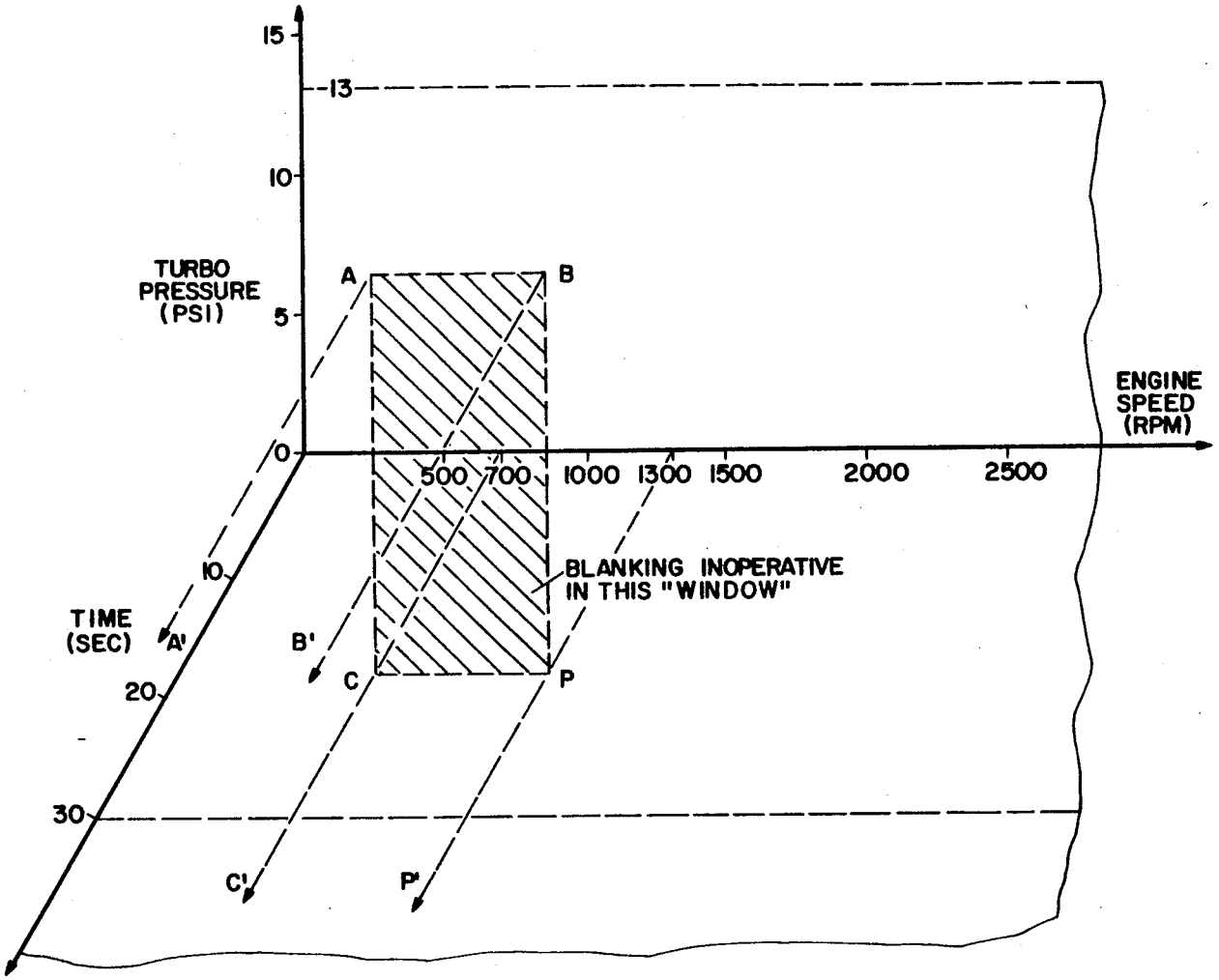
FIG. 9 is a graph showing the control "windows" for the blanking system of FIG. 6.

FIG. 9 is a graphic representation in which the dotted lines representing the condition which must exist with respect to turbo pressure, engine speed and time in order for blanking operations to be initiated by the system shown in FIG. 8. Once initiated, either engine speed or turbo pressure must be within the appropriate predetermined ranges to initiate blanking. The timer will re-set itself to require that the monitored conditions exist for a predetermined time before blanking is again initiated. The operator can override the system at any time at the on-off switch.

As shown in FIG. 9, cylinder blanking exists at low speeds and at upper RPM ranges. Thus, at idle or cruise, the system is operative to cause blanking to achieve economy. At intermediate speed ranges, as for example between 700 RPM and 1300 RPM, the blanking system is inoperative once the time requirement has been satisfied. In other conditions, such as at higher cruise ranges, cylinder blanking occurs. The inoperative range is identified by the parallelopiped, the corners of which are identified by A.B.C.D. This range is offset on the time axis a predetermined period of time, shown as 20 seconds. Blanking will continue for as long as the operative conditions exist. Once one of the control parameters falls outside the range, blanking occurs.

The present invention provides a novel system of achieving fuel economy. Various engine operating parameters or characteristics may be monitored to control the initiation of blanking. It will be obvious to those skilled in the art to make various changes, alterations and modifications to the system described herein. To the extent such changes, alterations and modifications do not depart from the spirit and scope of the appended claims, they are intended to be encompassed therein.

I claim:

1. A cylinder de-activation system for an internal combustion engine of the type having a cylinder block with a turbo charger, multiple reciprocating pistons, a fuel system including fuel injectors operable between a first fuel injecting position and a second inoperative position, and a mechanism for moving said injectors between said first and second positions, said de-activation system comprising:

(a) first sensing means for sensing the turbo pressure as a first operating characteristic of the engine to produce a control signal when said turbo pressure is of a predetermined pre-established value;

(b) blanking means operatively associated with selected of said injectors having a first inoperative position and a second operative position which overrides the said mechanism upon receiving a control signal and maintains said selected injector in said second injector position whereby fuel flow to the cylinder associated with the injector is terminated; and (c) timer means operably connected to said first sensing means to emit a control signal only if the turbo pressure is of a predetermined value for a predetermined period of time.

2. The cylinder de-activation system of claim 1 further including second means for sensing a second operational characteristic of the engine and producing a control signal throughout a predetermined range and wherein said first and second means for sensing an operating characteristic of the engine are operable so that both characteristics must be of predetermined values to initiate a control signal to move said blanking means to said second position.

3. The cylinder de-activation system of claim 2 wherein said second operational characteristic of the engine is engine speed.

4. A cylinder de-activation system for internal combustion engines of the type having a block with a turbo charger, plurality of reciprocating pistons, fuel injectors associated with each piston moveable between a first open fuel injecting position and a second closed position, cam actuated rocker engageable with said injector to position said injector between said first and second positions, said de-activation system comprising:

(a) actuator means having an actuated position engageable with said rocker arm to secure said injector in said second position blanking the associated cylinder;

(b) sensor means for sensing the turbo pressure of said engine and providing a control signal when said turbo pressure is within a predetermined range; and (c) control means responsive to said control signal to place said actuator means in said actuated position when said first operating condition has existed for a predetermined time period.

5. The cylinder de-activation system of claim 4 wherein said system includes a manual override.

6. The cylinder de-activation system of claim 4 further including second sensor means for sensing a second operating condition of the engine and producing a control signal when said first and second conditions are within predetermined values.

7. The cylinder de-activation system of claim 6 wherein said second operating condition is engine speed.

8. A cylinder de-activation system for an internal combustion engine of the combustion ignition type having an electrical system, an engine block with a plurality of reciprocating pistons in the block, a fuel injector associated with each cylinder moveable between a first fuel injection position and a second fuel flow-restricting position, a rocker arm pivotally mounted to move said fuel injector between said first and second positions, cam actuated push rod operatively engaging said rocker arm and turbo pressure generating means, said de-activation system comprising (a) housing means adapted to be positioned on said engine adjacent said rocker arm, said housing defining a cylinder chamber, said cylinder chamber having a piston reciprocal therein with locking means reciprocally carried on said piston and aligned with said rocker arm having a first position out of operative engagement with said rocker arm and a second position engaging said rocker arm;

(b) a fluid control valve for selectively delivering fluid pressure to said cylinder chamber, said fluid valve including an electric operator connected to said electrical system actuable from a first position with said control valve communicating said chamber with a reduced pressure area and a second position directing fluid pressure to said chamber;

(c) pressure switch means connected to a source of electrical energy responsive to turbo pressure of the engine to emit an electrical signal when the turbo pressure is within a predetermined range;

(d) timer means electrically connected to receive the output of said pressure switch means to transmit an electric signal to said electric operator only upon receiving a signal from said pressure switch for a predetermined period of time whereby upon receiving an electric signal from the timer, said electric operator will move said fluid control valve to said second position pressurizing said cylinder chamber to bring said locking means into engagement with said rocker arm thereby moving said injector to said first flow blocking position.

9. The cylinder de-activation system of claim 8 further including means for sensing engine speed and transmitting an electric signal thereacross when engine speed is within a predetermined range, said second sensing means being connected in series with said first sensing means between said electrical system and said timer.

10. The cylinder de-activation system of claim 9 further including manual override means for selectively connecting said system to said electrical system.

11. The cylinder de-activation system of claim 10 further including indicator means for indicating said system is connected to the electrical system and for indicating the existence of an electrical control signal to said electric operator.

12. The cylinder de-activation system of claim 11 further including plunger means interposed between said rocker arm and said push rod and being normally spring biased to engage said push rod.

* * * * *